United States Patent [19]

Didier

[11] 3,945,700

[45] Mar. 23, 1976

[54] CONNECTOR WITH FLUID-RESISTANT SLEEVE ASSEMBLY

[75] Inventor: Robert G. Didier, Palos Verdes, Calif.

[73] Assignee: Boston Insulated Wire & Cable Co., Los Angeles, Calif.

[22] Filed: Aug. 6, 1974

[21] Appl. No.: 495,181

[52] U.S. Cl. ..... 339/59 M; 339/105; 339/136 M; 339/259 R; 339/262 R

[51] Int. Cl.[2] ..... H01R 11/04

[58] Field of Search... 339/59 R, 59 M, 60 R, 60 M, 339/61 R, 61 M, 89 R, 89 C, 89 M, 94 R, 94 A, 94 C, 94 M, 105, 136 R, 136 M, 218 R, 218 M, 259 R, 262 R, 262 P, 262 RR

[56] References Cited

UNITED STATES PATENTS

| | | | |
|---|---|---|---|
| 2,917,722 | 12/1959 | Cobbett | 339/59 R |
| 3,448,632 | 7/1973 | Tanges | 339/259 R |
| 3,496,500 | 2/1970 | Romary | 339/60 M |
| 3,816,641 | 6/1974 | Iversen | 339/94 R |

FOREIGN PATENTS OR APPLICATIONS

| | | | |
|---|---|---|---|
| 602,982 | 8/1960 | Canada | 339/59 R |

OTHER PUBLICATIONS

G & W Electric Specialty Co., Advertisement, Electrical World, Sept. 12, 1960, p. 85.

*Primary Examiner*—Roy Lake
*Assistant Examiner*—Mark S. Bicks
*Attorney, Agent, or Firm*—Edmond F. Shanahan

[57] ABSTRACT

An electrical connector for a high voltage, high power cable for use in an environment of high pressure fluid. The connector is comprised of parts which can be assembled in place in the field with widely available tools, by unskilled operatives. The connector includes a generally cylindrical housing of rigid material, one end of which is designed to tightly enclose an armored cable and the other end of which is provided with a coupling ring for secure attachment to a feedthrough socket, a continuous outer protective sheath of rigid material thus being provided. Within the housing, a generally cylindrical contactor support body, fabricated of resiliently deformable insulating material, seats on the wall of the housing. A contactor for each of the contacts of the feedthrough socket is sealed within the contactor support body. The contactor support body includes a depending skirt portion formed by an axial opening into which the unsheathed end of an armored cable extends, the end of the armor sheath being terminated against a ring of rigid material through which the unsheathed portion extends. The conductors of the armored cable extend into the contactors to which they may be securely attached. The internal volume formed within the skirt portion of the contactor support body is further occupied by additional resilient insulating bodies having openings through which the conductors pass. Pressure-resistant sealing, as by bonding or molding, is provided at critical surfaces as required to maintain the integrity of the housing, the interior of the contactors and the point of juncture with the feed through socket.

17 Claims, 15 Drawing Figures

FIG. 6.
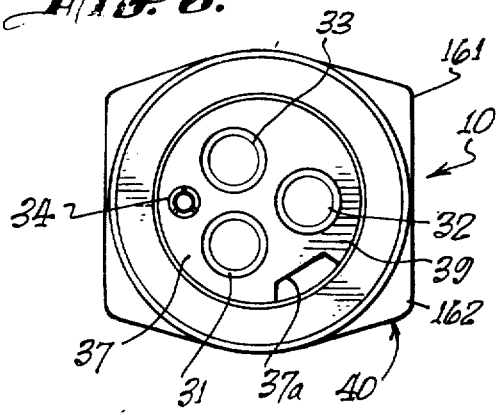
FIG. 9.
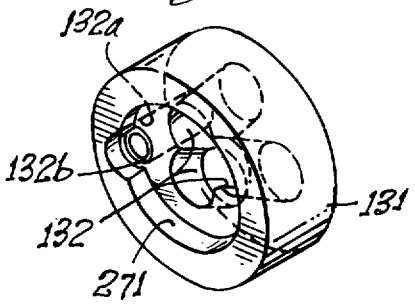
FIG. 7.
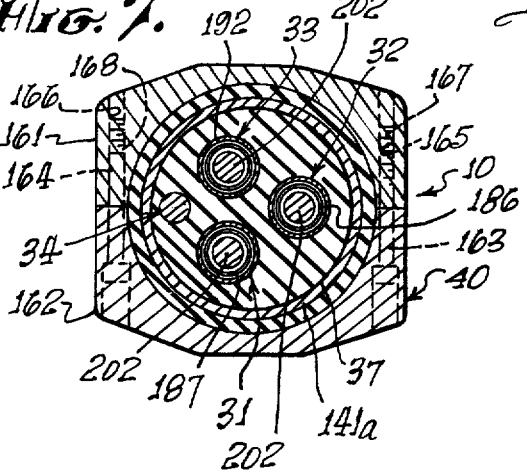
FIG. 10.
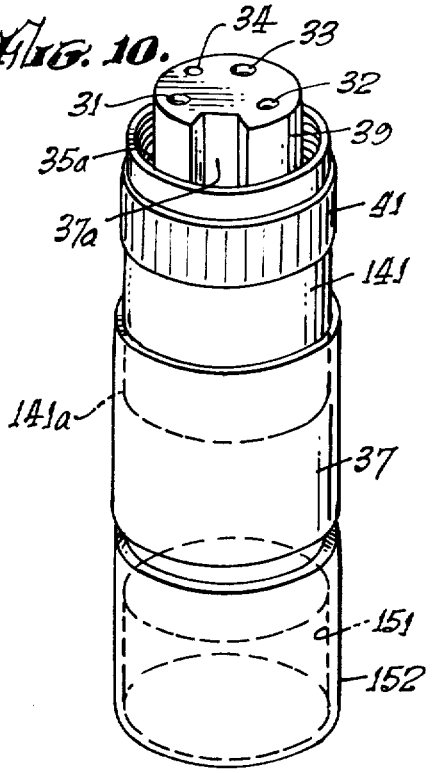
FIG. 8.
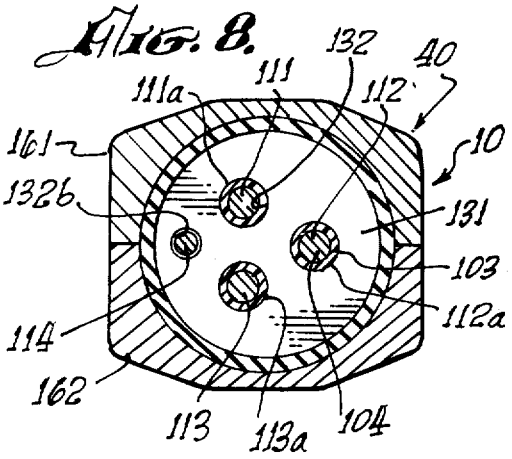
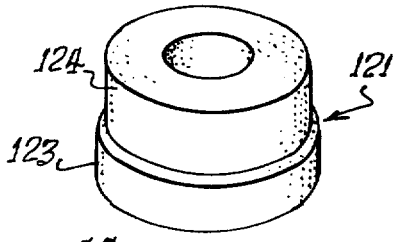
FIG. 11.

CONNECTOR WITH FLUID-RESISTANT SLEEVE ASSEMBLY

This invention relates to electrical connectors for connecting a heavy industrial electrical power cable to a power supply socket within an environment of high pressure fluids, so that it is difficult to provide electrical integrity at the connector. The connector of the invention was developed for use in connecting an armored cable within an oil well casing to the electrical power feed-through socket in the head of the oil well. In deep oil wells, it is necessary to provide electrical power, from a power source outside the wellhead, through a pressure-retaining wellhead fixture, down a long armored power cable within the oil well casing, to an electrical pump motor located within the casing thousands of feet below the surface. Typically, the power is supplied at an industrial high voltage, for example, 2400 volts, three phase, 60-cycle alternating current. In such an environment, the connector is exposed to liquids such as oil or water, or gases, such as flammable hydrocarbon gases, under pressures of several thousand pounds per square inch. The invention will be described in connection with its oil well pump application, but it will be understood that it may be employed in other applications requiring electrical connection of similar substantial power loads in a similar environment of high pressure fluids.

More particularly, the connector of the present invention is an assembly of parts specially fabricated in the factory, so that the connector can be assembled to the end of an armored cable at a typical oil well site.

Heretofore, it has been considered impractical to attach a high power electrical connector directly to the cable end under the adverse conditions often prevailing in the oil field, and with no tools or personnel other than those generally present and in oil field locations. Heretofore, when an electrical connector was required for the armored cable supplying power within an oil well, it has been the almost universal practice to attach the connector to a short piece of cable under factory conditions. The connector, together with its short piece of cable attached, was then shipped to the oil field, and the oil field workers spliced the connector cable to the oil well cable. This method has proven to be extremely costly and time-consuming. The typical oil well site is located remote from the factory or shop at which the connector was attached to its short cable length. Sometimes, it has been necessary to fly a connector, factory mounted on its short piece of cable, half way around the world to a well site.

A second disadvantage of the previously known general practice has been the unreliability of splicing. In spite of great skill and ingenuity by competent oil field workers, adverse conditions at the well site have resulted in splices with concealed defects, which failed after being placed in operation, with resultant expensive operation shut down and repair, and sometimes resulting in costly accidents.

The electrical connector of the present invention can be attached to an armored cable end, under typical oil field conditions, with much less difficulty than splicing and with much greater assurance of subsequent reliable operation than cable splicing performed under oil field conditions.

A typical oil wellhead, in which the connector of the present invention might be used, is illustrated and described in U.S. Pat. No. 3,437,149, issued Apr. 8, 1969, to E. T. Cugini, et al., for a "cable feed-through means and method for wellhead constructions." Some elements of the Cugini wellhead are also illustrated in FIG. 1 of the drawings of this Patent Application.

The wellhead construction illustrated in the Cugini patent, and in the drawings of the present Patent Application, is assembled at the well site by the oil field workers. The high pressure liquids and gases present within the oil well casing are stopped off below the ground surface by special devices inserted into the casing for temporarily confining the high pressure fluids below them within the casing, all according to a technology well known to those familiar with the oil well art. The Cugini patent illustrates a typical wellhead construction, including an electrical feed-through, with an electrical power socket, to which an armored cable may be connected by an electrical connector. The electrical connector of the present invention will be described by reference to attachment of the connector to an armored cable, such as that employed in oil wells, which connector is intended to be threaded on to a typical feed-through socket.

In the past, as already described, the assembly seen in Cugini would be produced by splicing a short piece of cable 16 carrying a factory-installed connector 67 (referring to the numerals in the Cugini patent drawings).

With the electrical connector of the present invention, it is practical to keep in the field an inventory of the connectors themselves, in a disassembled condition, since they can be assembled and attached to the armored cable in the field. Moreover, the electrical connector of the present invention can be removed from a cable end and reused on another cable.

As will be seen from the following description, the electrical connector of the present invention is much simpler to install than the procedure for making a cable splice; and experience with the connector of the present invention has established that it does not involve the risks to electrical integrity of splicing at an oil well site.

The foregoing and other objects and advantages of the electrical connector of the invention will be understood from the following description of preferred embodiments of the invention, which should be read with reference to the accompanying drawings.

BRIEF DESCRIPTION OF THE DRAWINGS

FIG. 1 shows the production tubing, the feed-through, and an electrical connector constructed according to the present invention, and field-installed on the end of an armored electrical cable;

FIG. 6 is a top plan view of the connector of FIGS. 2 and 3, as viewed looking downward, as indicated by the arrows 6—6 in FIG. 3;

FIG. 7 is a transverse sectional view, looking downward at a horizontal plane indicated in FIG. 3 by the arrow 7—7;

FIG. 8 is a view of a transverse section of the connector of FIG. 3, looking downward at a horizontal plane indicated in FIG. 3 by the arrows 8—8;

FIG. 9 is a perspective view of a conductor alignment body employed in the interior of the connnector of FIGS. 2 and 3;

FIG. 10 is a perspective view of a coupling subassembly, comprising a rubber-seal body, a coupling sleeve carrying a rotatable coupling nut, and the internally mounted contact assemblies of FIGS. 4 and 5;

FIG. 11 is a pres;ective view of a rubber cable-seal body employed adjacent to the cable end of the connector of FIGS. 2 and 3;

FIG. 13 is a longitudinal sectional view of the connector. FIG. 14 shows the female feed-through socket partially broken away. FIG. 15 is a lower end plan view of the female socket of FIG. 14.

Throughout the specification and claims, the word "insulating" is used with reference to electrically insulating material.

DESCRIPTION OF PREFERRED EMBODIMENT

One preferred embodiment of the invention, showing an electrical connector with female contactor tubes at the coupling end, is described in the following description of FIGS. 1 to 11. The embodiment of FIGS. 1 to 11 is also characterized by a housing consisting of two half cylinders bolted together.

Figure 12:
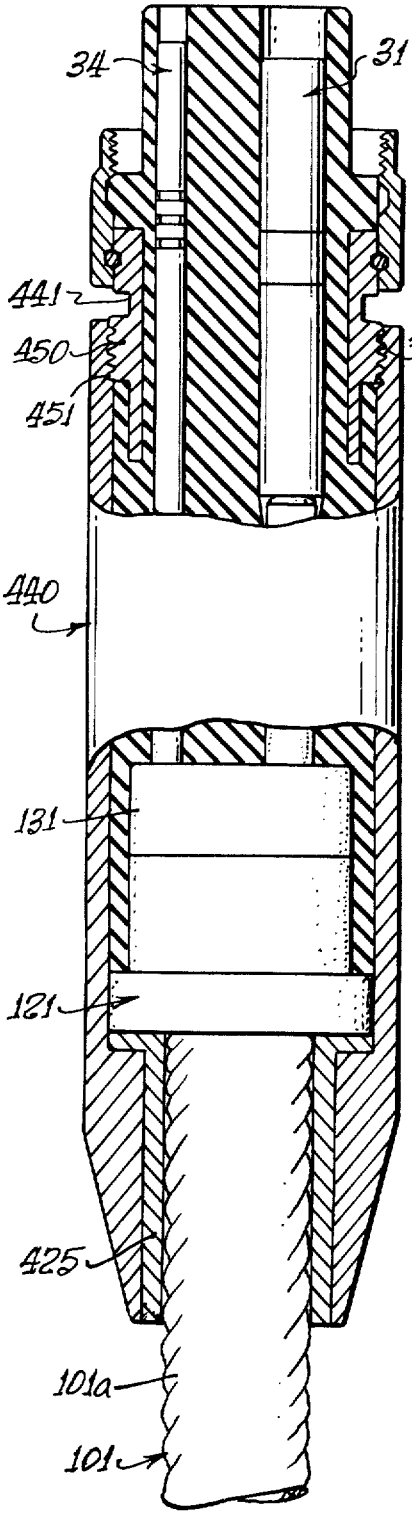
FIG. 12 is a longitudinal view, partly in section, of an alternative construction of the inventions, which employs a cylindrical shell threaded to the coupling sleeve.
Figure 13:
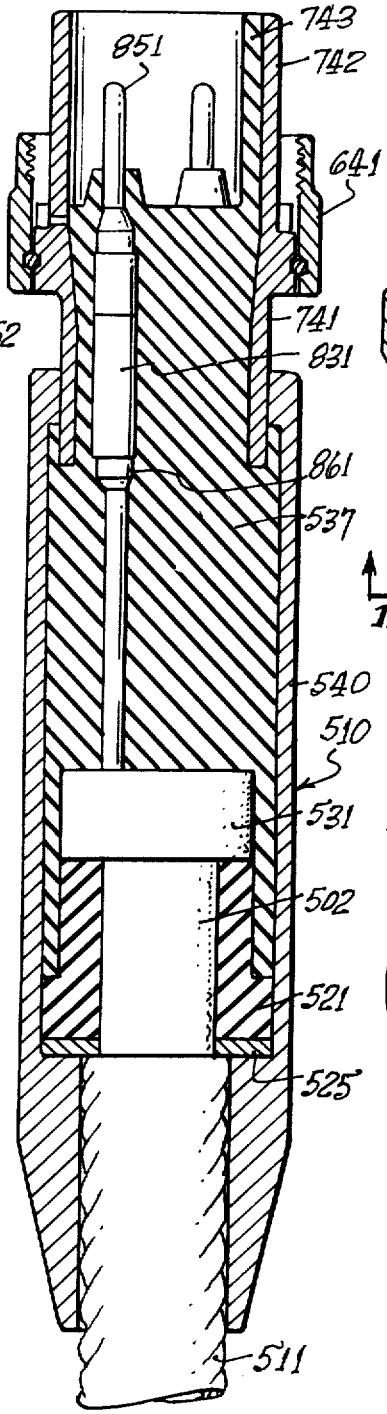
FIGS. 13, 14 and 15 are cross-sectional views showing a male contactor form of the electrical connector of the invention.

FIG. 12 is an alternative preferred embodiment employing an integral cylinder housing. FIG. 13 is another preferred embodiment showing the electrical connector in a form in which the connector incorporates male contactors for reception in a female feed-through socket.

Certain conventions of descriptive language are adopted herein, both in specification and claims, for purposes of clarity and convenience and not with any purpose of implied limitation to the oil well art, or to a vertical disposition of parts as is usually the case within the oil well casing.

The terms "upstream" and "downstream" refer to the coupling and cable attachment ends of the electrical connector, respectively. In a typical wellhead installation, the upstream end is upward, and upstream with respect to the delivery of electrical power, although not with respect to the upwardly pumped oil. Correspondingly, at such an installation, the downstream end of the connector is in a downward direction within the vertical oil well casing, and downstream in the direction of electrical power delivery.

The terms "feed-through", "feed-through socket", "feed-through contacts", and other parts of a feed-through structure are adopted from the terminology of oil well technology, in order to describe generally, without restriction to oil well technology, the kind of electrical socket means for which the electrical connector of this invention was invented. The electrical connector of the present invention finds its utility in an environment of high pressure fluid, such as oil well liquids and gases at pressures as high as 5,000 pounds-per-square-inch. Such high-pressure fluids are separated from a working zone for human workers under atmospheric pressure by some type of confining structure, for example, an oil well casing and wellhead assembly. Ordinarily, electrical power is delivered from the working zone to the interior of the confining structure by means of an electrical power feed-through following construction well known to those familiar with the oil well art, as well as other related arts, a description of one embodiment being shown in the Cugini patent already mentioned. However, the term feed-through herein means simply any delivery of electrical power to a zone of high fluid pressure, even though the power originates in a zone of high fluid pressure.

THe electrical connector of the invention may be constructed with contactors of either female or male structure to accommodate male or female feed-through sockets, respectively. Both female and male electrical connectors are illustrated, described and claimed, generically and in preferred specific embodiments.

The electrical connector of the invention was invented for field attachment to an armored cable. However, it is not intended to restrict the application of the invention to a cable having any particular kind of outer jacket performing the function of "armor." Many forms of wire or sheet metal winding are employed on armored cable to provide a flexible steel armor. The invention includes cable which is armored by any strong, flexible, protective jacket resistant to high pressure fluids, even if it were to be fabricated of a non-metal material performing the same function as the steel armor.

The electrical connector of the invention is employed with armored cables of a type which frequently incorporate three relatively heavy power conductors, and one relatively light-weight instrumentation conductor. Such four-conductor cable is often employed as a standard, being used even in situations where the instrumentation conductor is not active at all. The most important features of the present invention are related to the power conductors. Electrical conduction through the electrical connector of the invention is provided by a plurality of conducting means referred to throughout the specification and claims as "contactor tubes." However, it will be appreciated that the contactor tubes employed for the power conductors are more elaborate in construction than the contactor tube used for the instrumentation conductor. Consequently, the claims have been written in a form allowing for this, such as, "at least one of said contactor tubes . . . ."

The term contactor tube is used as a standard for the electrical conduction means employed in the electrical connector of the invention, since the contactors used in the electrical connector of the invention are always tubular, at least, in part. However, as will be seen from subsequent description of FIG. 13, the male contactor version of the electrical connector, the contactor tube may actually be tubular only in the downstream end, and be a solid metal probe in its upstream section. Also, the contactor tube for the instrumentation conductor is actually a solid rod throughout most of its length, being tubular only at one or both ends. Nevertheless, the term contactor tube is used as a generic term for all of the contactor means employed in the electrical connector of the present invention, in all versions.

The electrical connector of the invention is described as supporting the contactor tubes, as well as the cable end, within three "bodies fabricated of resilient, rubber-like, insulating material deformable under the pressure of the fluid in the environment." The deformable bodies, generally three in number, are housed within a rigid confining structure, generally made of steel parts. The confining structure is principally a steel housing, a steel armor-fitting ring, a steel coupling sleeve, and threaded steel coupling ring, in most cases. The electrical connector of the invention is able to maintain electrical integrity in the presence of a high-pressure fluid, even if the fluid leaks into the interior of the rigid metal confining structure, since the high-pressure fluid presses the deformable bodies into closer sealing and insulating inter-engagement with each other and with the conducting metal contactor tubes. This principle is not new with the present invention, but it is employed in a novel assembly of parts, which, for the first time, makes available an electrical connector of the present type which can be attached to an armored cable under primitive field conditions, with greater ease than the splicing of cable.

Throughout the specification and claims, reference is made to "bonding" and "hermetic sealing", as generally including any type of assembly which meets the dielectric and mechanical requirements of the connector under the particular environmental conditions specified. In general, a bonding adhesive is used for attaching a cable-seal body to the rubber sheath of the armored cable in the field. However, bonding may also be achieved simply by molding the contactor tubes into the contactor tube support body at the factory. Both methods achieve "bonding" and "hermetic sealing" within the meaning of this specification and claims.

Figure 1:
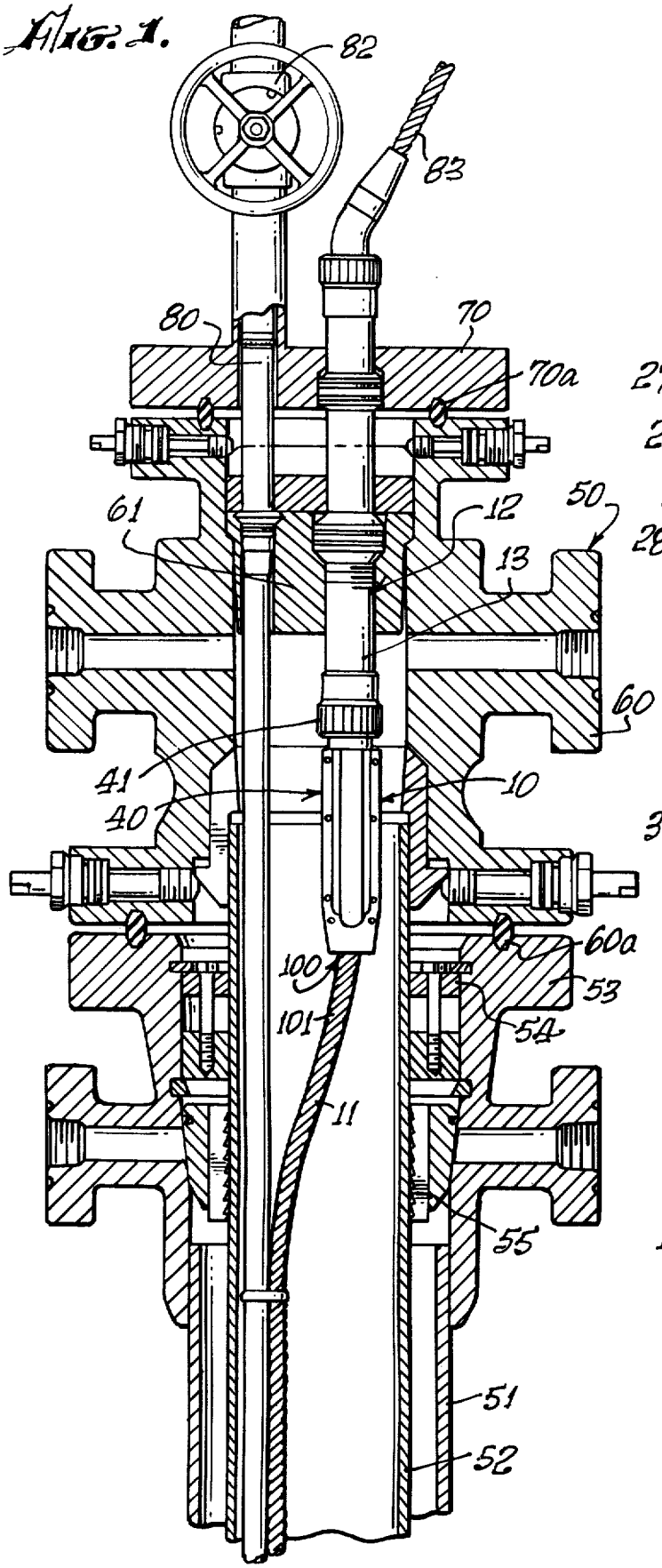
FIG. 1 is a simplified section view, partly in elevation, of an oil wellhead, showing the upper ends of the surface and production casing, and a simplified wellhead Christmas tree in section; and internally.
Figure 2:
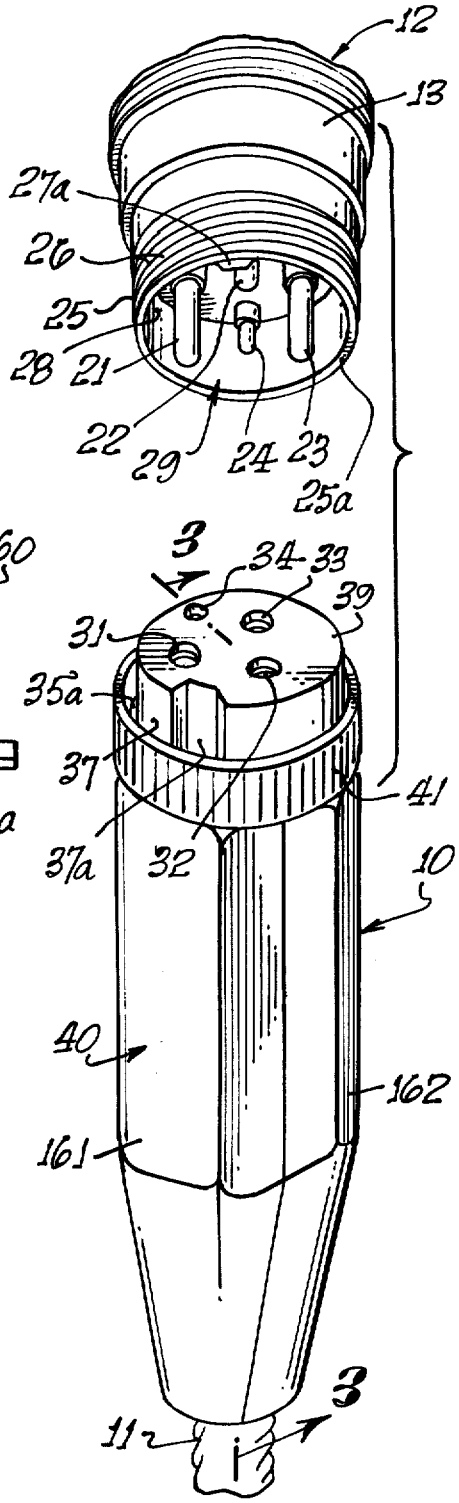
FIG. 2 is an enlarged perspective view of the connector of FIG. 1, looking down at the coupling end; also included in FIG. 2 is a fragmentary part of the lower end of a feed-through, showing the feed-through socket to which the connector couples.

FIGS. 1 and 2 show an electrical connector constructed according to the invention as it would appear installed for use in an oil wellhead typical of its principal and preferred use. The electrical connector 10 is illustrated already assembled onto the upstream end of an armored electrical cable 11. In FIG. 1, connector 10 is seen inside elevational view, already coupled to a feed-through socket, indicated generally by the numeral 12, located at the downstream end of a feed-through 13, which is of standard construction well known to those familiar with wellhead structures used in oil fields. In FIG. 2, the downstream end of feed-through 13 is shown in perspective, so as to reveal the details of feed-through socket 13.

FIG. 2 reveals that feed-through socket 13 has socket conductors of the male probe type, three power conductors 21, 22 and 23, and one instrumentation conductor 24. Correspondingly, electrical connector 10 is of the female contractor type, being provided with internal conductors in the form of contactor tubes, to be described in detail hereinafter, but designated as the three power contactor tubes 31, 32, and 33, and instrumentation contactor tube 34, all designed to make mating contact with socket contactors 21 to 24.

It will also be seen from FIG. 2 that the feed-through socket designated generally by the numeral 13 includes a cylindrical steel socket housing 25, provided with external threads 26. Also, socket contactor probes are supported in an insulating socket body 27, which is spaced upstream from the downstream opening 28 of socket 13 so as to leave a cavity designated herein as receptacle 29. Associated with receptacle 29 is an interior, longitudinally-disposed key **27*a*, which is an integral part of socket insulating body 27**.

Correspondingly, in electrical connector 10, the contactor tubes 31 to 34 are supported, in radial alignment with socket contactors 21 to 24, by a contactor support body 37, which substantially fills most of the interior of a housing 40, and has an upstream projection 39 for substantially filling receptacle 29, and is provided with a key way **37*a*, mating with key 27*a*, so as to prevent rotation of connection 10 relative to feed-through socket 12. A coupling ring 41, in this case an internally threaded coupling nut, is rotatably mounted on the upstream end of connector 10 in a manner to be described hereinafter, and provides threaded coupling on threads 26 of socket 12**.

It will be appreciated that the downstream end of socket housing 25 provides an annular sealing shoulder **25*a*, which is adapted to seat directly on an external annular shoulder 35*a* on contactor tube support body 37**.

FIG. 1 shows electrical connector 10 as it would appear, if seen in cross-section, installed in a typical wellhead. FIG. 1 shows in vertical cross-section a wellhead "Christmas tree", indicated generally by the numeral 50. Christmas tree is the oil field term to identify the wellhead structure topping the oil well casing 51 at ground level. Inside of the outer or surface casing 51, there is a smaller diameter production casing 52, typically supported by a casing head means 53, of typical construction well known to those familiar with oil field technology. Typically, it includes packing means 54, and hanger means 55.

Above casing head means 53 is an upper casing head body 60, which provides support for a hanger body 61. Above upper casing head means 60 is a seal flange 70. Gasket rings **60*a* and 70*a* are provided on the undersides of upper casing head means 60 and seal flange 70** respectively.

Production tubing 80 is supported from hanger body 61, and delivers oil through an external valve 82 in a manner well known to those familiar with oil field technology.

An electrically powered pump, located deep within the oil well, at the bottom of casing 52, is not illustrated. It is supplied with electrical power from an outside source through an exteriorpower cable 83, which delivers power to feed-through socket 12 at the lower end of feed-through 13, which is supported in hanger body 61. The electrical connector 10 of the invention, provides connection means to internal armored cable 11, for delivery of electrical power to the oil well pump.

It will be appreciated that the assembly seen is constructed under atmospheric conditions by skilled oil field technicians, with blow-out means temporarily in position to confine the high-pressure fluids within casing 51 and casing 52, at some point below the Christmas tree 50 illustrated in FIG. 1. After the Christmas tree 50 and all enclosed apparatuses are assembled and ready for operation, the blow-out means, not illustrated here, is released and the high-pressure fluids surge into the interior of casing 52, and impose a severe test of the electrical integrity of connector 10.

Figure 3:
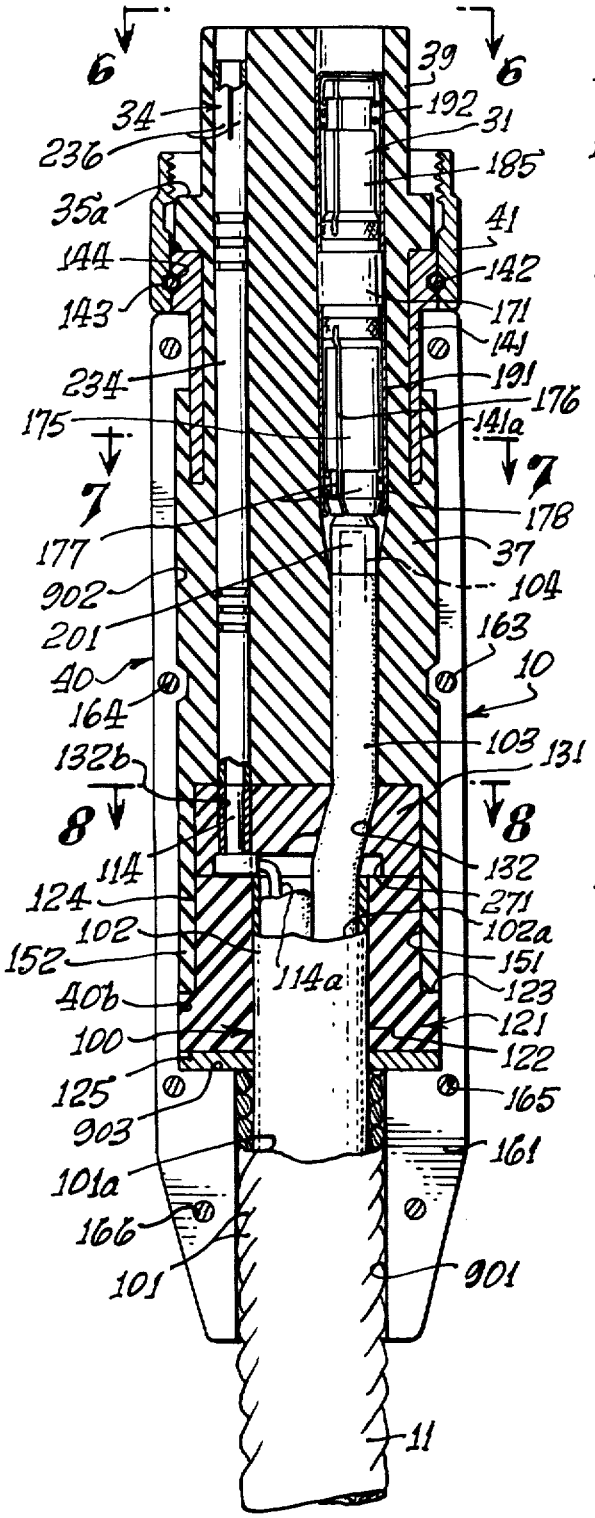
FIG. 3 is a sectional view through the electrical connector of FIG. 2 as viewed at a vertical axial plane, indicated by the arrows 3—3 in FIG. 2.

FIG. 3 is a vertical sectional view of electrical connector 10, as viewed at a vertical plane through its longitudinal axis. Parts of the upstream end of armored cable 11 are broken away to show the successive sections of uncovering of cable conductors within connector 10.

Connector 10 is attached to the upstream cable end, indicated generally by the numeral 100, by engaging it at successive sections. Cable end 100 is seen to be enclosed within connector 10 by an armored section 101, a sheath section 102 from which the armor 101*a* has been removed, an insulated conductor section 103, at which the rubber insulating sheath 102*a* has been removed, and a bare conductor section 104 (seen in dashed outline), at which the cable conductors seen in cross-section in FIG. 8, have been stripped of insulation for electrical contact with parts of the electrical connector 10 to be described hereinafter. In FIG. 8, the three power conductors are indicated by the numerals 111, 112, and 113, and the instrumentation tip by the number 114.

Figure 5:
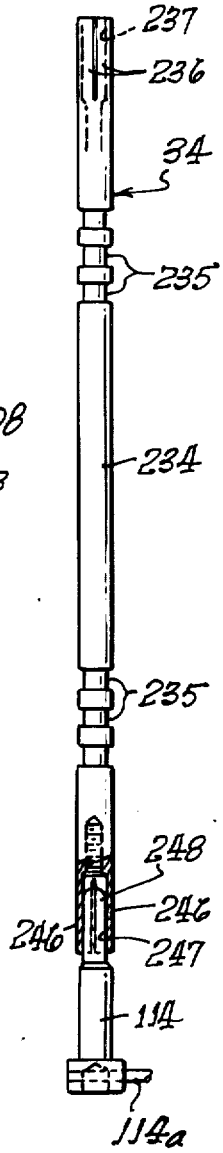
FIG. 5 is an enlarged view of the contactor tube used for connecting the instrumentation conductor within the connector of FIGS. 2 and 3.

Instrumentation tip 114 is mounted on the end of instrumentation conductor 114*a* as seen in FIGS. 3 and 5.

Also, FIG. 8 reveals that each of the conductors is encircled by its insulation 111*a*, 112*a*, and 113*a* respectively. In addition, instrumentation tip 114 is seen enclosed in bushing 132*b*. The instrumentation conductor 114*a* is soldered to the small instrumentation tip in the cavity between the upstream end of the cable-seal body 121 and the downstream end of the conductor alignment body 131.

It will be seen from FIG. 3, and the preceding description, that the conductors 111 to 114 of armored cable 11 are placed in electrical connection with socket contactors 21 to 24 by the connection of cable end 100 to contactor tubes 31 to 34, entirely enclosed and supported by three insulating bodies, typically molded rubber, each having a special function, and the three filling most of the interior of housing 40.

At the downstream end, a tubular cable-seal body 121, seen in perspective view in FIG. 11, is bonded at 122 to cable sheath 102*a*, to provide continuous insulation, and hermetic sealing under the pressure of the environmental fluid within connector 10. It will be seen that cable-seal body 121 has a downstream annular shoulder 123 making contact with the interior walls 40*b* of housing 40; but that the upper cable-seal body 124 is of reduced diameter, and spaced away from said interior wall 40*b*.

In the preferred form of the invention, a rigid armor-fitting ring, 125, typically fabricated of steel, provides a strong confining wall between the downstream end of cable-seal body 121 and the upper edge termination of armor 101*a*.

A second rubber molded body, a conductor alignment body 131, seen in perspective in FIG. 9, seats on the upstream end of upper cable-seal body 124, and provides a plurality of internal passages 132, which diverge upwardly to increase the radial spacing of the insulated conductors 111 to 114 from the smaller radial spacing of cable 11 to the greater radial spacing of feed-through socket contactors 21 to 24. The upstream end of passages 132 can be seen in the sectional view of FIG. 8. It will be seen from the sectional view of FIG. 3 that the diameter of conductor alignment body 131 is less than the internal diameter of housing 40, so that there is an annular space between cable alignment body 131 and internal housing walls 40*b*.

A third and largest molded rubber body, filling most of the interior of housing 40, is contactor tube support body 37. It provides resilient mechanical support for contactor tubes 31 to 34; it provides the insulation between contactors tube 31 to 34 and housing 40; and it is hermetically sealed to the exterior sidewalls of contactor tubes 31 to 34 to resist unwanted penetration of the high-pressure fluids in the environment. Furthermore, it supports, on an intermediate part of its exterior surface, a rigid coupling sleeve 141, on the upstream end of which coupling ring 41 is rotatably mounted, typically by retainer ring 142 carried in retainer grooves 143 and 144.

FIG. 10 is a perspective view of the contactor assembly as it is fabricated at the factory and delivered to the well site, for field installation on armored cable 11. The contactor tube support body 37 is shown with the coupling sleeve 141 already molded in place for bonding and hermetic sealing; the downstream end 141*a* is seen in dashed outline in FIG. 10, in the vertical sectional view of FIG. 3, and in the cross-sectional view of FIG. 7 as embedded in molded rubber support body 37. The upstream projection 39 of contactor tube support body 37 is also seen in perspective in FIG. 10, as in FIG. 1. Coupling ring 41 is shown factory-assembled in place on coupling sleeve 141.

It will be understood that the contactor tubes 31 to 34 are also molded in position in the factory assembly of FIG. 10, but they are not shown in dashed outline, in order to avoid cluttering the drawing.

FIG. 10 does disclose in dashed outline, however, that the downstream end of contactor support body 37 is provided with a large downstream recess 151, seen in dashed outline in FIG. 10, and in cross-section in FIG. 3. Recess 151 fits closely around upper seal body 124, and alignment body 131. The tubular sleeve 152, formed of molded rubber integral with support body 37, seats on shoulder 123 at its downstream end. The outer surfaces of sleeve 152 close fit the interior sidewalls of housing 40*b*.

It is important to understand that fluid under pressure which leaks into the interior of housing 40 presses skirt 152 against the mating surfaces of upper cable-seal body 124 and alignment body 131 to provide electrical integrity and security against the penetration of said high pressure fluids.

All three insulating bodies 121, 131, and 37 are molded of rubber or a rubber-like insulating material. This material, although mechanically strong, is slightly deformable under great fluid pressure or mechanical pressure, particularly at relatively thin cross-sections as in skirt 152. Also, at sealing shoulders, such as annular sealing shoulder 25*a*, and annular sealing shoulder 123, a slight deformation must occur to accommodate minute irregularities in the adjacent steel surfaces, to achieve hermetic sealing against the fluids under high pressure. This is the type of deformability which is meant when reference is made herein to the bodies 37, 121 and 131 as fabricated of deformable material. Actually, deformation is minute, except, relatively, at skirt 152, where greater deformation occurs under fluid pressure in order to achieve hermetic sealing against bodies 121 and 131.

It will be seen from FIG. 2 and the cross-sectional views of FIGS. 7 and 8, that housing 40 is actually comprised of two mating halves 161 and 162, which are tightly bolted together by means of threaded fasteners 163 and 164 (seen in FIG. 7), which are received in mating bores 165 and 166, said bores being partially internally threaded, as at 167 and 168. However, it will be understood that said housing can be constructed as a unitary cylinder as illustrated in FIG. 12, and there indicated by the numeral 440. Cylindrical housing 440 has an upstream opening 450 which is provided with internal threads 451. Mating external threads 452 are provided on coupling sleeve 441.

FIG. 12 also shows an alternative form of armor-fitting ring 425, which is formed as a tubular member closely receiving armor 101*a*, and disposed between the interior of the downstream end of housing 440 and the outer surfaces of armor cable end section 101.

Figure 4:
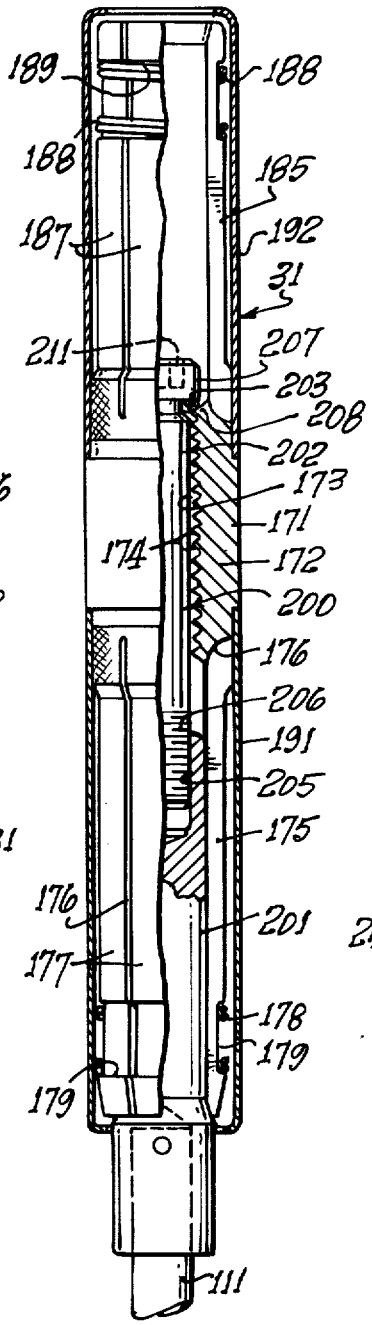
FIG. 4 is an enlarged view of one of the three contactor tubes employed in the connector of FIGS. 2 and 3, for connecting the three power conductors.

FIG. 4 shows a preferred form of contactor tube assembly for power contactor tubes 31, 32 and 33.

The contactor tube assembly of FIG. 4 is indicated generally by the numeral 31. Its principal part is a contactor tube 171, which typically may be machined from a solid rod of beryillium copper. Contactor tube 171 is shown partially sectioned to reveal internal parts of the contactor tube assembly 31, and the cross-section of contactor tube 171. Tube 171 is seen to have a thick-walled intermediate section 172, having a maximum external diameter closely fitting and molded to the adjacent walls of molded rubber body 37. Intermediate section 172 has a relatively small diameter bore 173, which may be provided with internal threads 174 for convenience in handling during manufacture, for example, in support during molding of body 37.

The downstream end 175 of tube 171 is of reduced cross-section and longitudinally slitted by slits 176, so that it is separated into two or more resilient fingers 177, which are urged inwardly by a spring 178, which may be conveniently retained in an external annular spring groove 179.

The upstream end 185 is similarly slitted by slits 186, to provide spring fingers 187 which are inwardly urged by a spring 188 contained in groove 189. Downstream end is enclosed in a tubular housing 191, and the upstream end 185 is contained in an upstream housing 192. The outer surfaces of housings 191 and 192 are hermetically sealed to body 37 during molding, and their interior cavities provide a freedom for slight movement of spring fingers 177 and 187.

Spring fingers 187 form the female contactor recess for receiving a corresponding one of power socket probes 21 to 23. The upstream end of conductor 111 is mechanically and electrically connected to contactor tube 171 by an anchoring assembly indicated generally by the numeral 200, and comprised of a tip 201, a threaded fastener 202, and a sealing ring 203. Tip 201 is firmly secured to conductor 111, for example, by soldering or crimping. The upstream end of tip 201 has an internally threaded bore 205, which receives the threaded end 206 of fastener 202. An enlarged fastener head 207 at the upstream end of fastener 202 seats on an internal annular shoulder 208 on the interior sidewalls of contactor tube 171, sealing being provided between head 207 and shoulder 208 by sealing ring 203.

Head 207 is provided with torqueing surfaces, for example, a torqueing recess 211.

Instrumentation contactor tube 34 may be of much simpler construction because of the low voltages involved. In FIG. 5, a preferred embodiment is shown as a solid rod 234, provided with external annular groove 235 for secure support within molding 37. Longitudinal spring fingers 236 are machined in the upstream end to provide a tubular recess 237 for reception of instrumentation probe 24 in socket 12. The downstream end of instrumentation contactor tube 34 is likewise machined to provide spring fingers 246 and a downstream recess 247, which closely receives the upper end 248 of instrumentation tip 114 attached to the end of instrumentation conductor 114*a*.

In the preferred embodiment illustrated in FIG. 1 through 11, the downstream end of alignment body 131 is provided with a recess 271, to facilitate installation. However, parts of this recess not filled by the insulated power conductors 103 may be filled by a loop of instrumentation conductor 114, covered by its insulation 114*a*.

Figure 14:
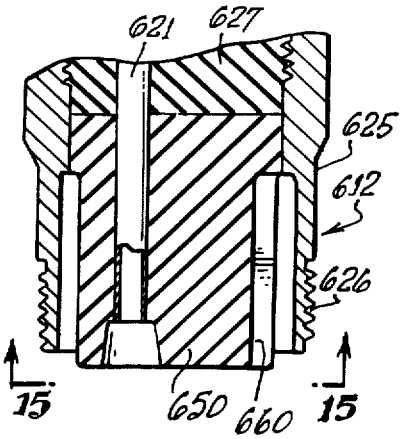
Figure 15:
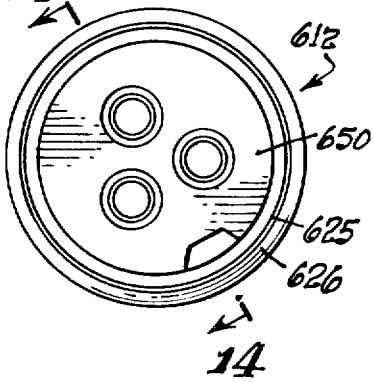

FIGS. 1 to 11 illustrate the female contactor form of the electrical connector of the invention, which has a substantial advantage the the power conductors can be anchored in position by means of the anchoring assembly 200. However, a less preferred embodiment of the invention is an electrical connector employing male contactor members. Such an electrical contactor is illustrated in FIGS. 13, 14 and 15, and is indicated generally by the numeral 510. It has many parts substantially identical to corresponding parts in electrical connector 10, including an identical housing 540, an anchor ring 525, and armored cable 511, with a sheath section 502 encircled by a cable-seal body 521. Also, identical is cable alignment body 531. However, the upstream end of electrical connector 510 is substantially different from the upstream end of connector 10, since it must mate with a female contactor type of feed-through socket, a typical form of which is illustrated in FIGS. 14 and 15. The longitudinal sectional view of FIG. 14, and the bottom plan view of FIG. 15 reveal that female-type feed-through socket 612 comprises a socket housing 625 with threads 626, which threads 626 mate with threaded coupling ring 641 rotatably mounted on coupling sleeve 741.

Female socket contactors, illustrated by typical female socket contactor 621, are supported in a socket insulating body 627, which has a downstream projecting section 650. Projecting section 650 has a smaller diameter than the interior of socket housing 625, in order to receive an upper extension 742 of sleeve 741.

In the embodiment of FIGS. 13 to 15, the molded rubber key is key 743 on the interior of sleeve extension 742, whereas the key way provided is a key way 660 provided in the sidewall of projecting section 650.

Electrical connector 510 employs a contactor tube support body 537 which does not have the projecting portion 39 of the contactor support body 37 in electrical connector 10.

Most importantly, the upstream end of the typical contactor tube 831, is a male contactor probe 851. Contactor tube 831 is tubular only in its downstream portion, where it receives a tip 861, but the upstream probe 851 is solid, and the anchoring assembly 200 is not provided.

However, it will be understood that if an anchoring assembly is desired, the contactor tube of FIG. 4 could be used, and a probe exactly like probe 851, but constructed simply as an extra part, could be inserted therein after installation of anchor 200.

It should be noted that there are preferred longitudinal dimensions for the cavities of housings 40, 440 and 540. This preferred feature may be described with reference to FIG. 3, as typical. In FIG. 3, it will be seen that downstream housing 40 actually comprises a substantially cylindrical downstream cavity 901, and an upstream cavity 902 of much greater diameter and length. Downstream cavity 901 is provided to accommodate armor section 101. Preferably, it has a longitudinal extent substantially greater than the diameter of armored cable 11. The upstream end of downstream cavity 901 terminates in an internal annular shoulder 903 which provides a structurally secure seat for armor-fitting ring 125.

The increased diameter of upper cavity 902 provides for an adequate cross-section of dielectric material in body 37 for insulating contactor tubes 31 to 34 at the increased radial spacing of socket contactors 21 to 24.

The substantial length of cavity 902 permits the use of power contactor tubes 31 to 33 with longitudinally extended contactor fingers 177 and 187 for more resilience in contact engagement. Finally, substantial size of contactor support body 37, and the resilient mounting therein of contactor tubes 31 to 34, permitting a certain amount of adjustment to misalignment between contactor tubes 31 to 34 and socket contactors 21 to 24.

Male-female interlocking sealing is provided between the support body 37 and the socket body 27 (in the female connector form of FIG. 3.), and between support body 537 and socket body 627 (in the male connector form of FIG. 13); all four of these bodies are made of electrically insulating rubber or the like, so that their mating under pressure provides both hermetic sealing and electrical security.

I claim:

1. An electrical connector for connecting an armored cable, with multiple conductors to a feed through socket;

a substantially cylindrical housing made of rigid material and axially aligned with said armored cable, said housing having an upstream end adjacent said socket and a downstream end adjacent said cable;

an armor-gripping shoulder at the downstream end of said housing, said shoulder providing an internal surface, substantially cylindrical, closely fitting the exterior surface of the armor of said armored cable;

means at the upstream end of said housing for securely fastening said electrical connector to said feedthrough socket;

a contactor assembly comprising;

a contactor support body made of a resilent rubber-like, dielectric material, said body substnatially filling the upstream portion of said housing, said body having an axial opening in the downstream end to provide a depending skirt of tubular configuration;

a plurality of contactor tubes supported within said contactor support body, one contactor tube for each of the conductors of said cable, said tubes being made of conductive material, said tubes being aligned in an upstream-downstream direction, each of said tubes having a downstream opening for reception of one of the conductors of said cable, each of said tubes having an upstream electrical contactor portion mating with a corresponding contactor in said feedthrough socket;

a cable-seal body made of resilient, rubber-like dielectric material, located within the downstream end of said housing, upstream from said armor-gripping shoulder, and including bonding means to a cable-end of said armored cable from which the armor has been removed; and an alignment body made of a resilient, rubber-like dielectric material, said alignment body being disposed within said axial opening at the downstream end of said contactor support body and said alignment body having passages to accommodate the conductors from said cable end, and to place them in disposition for entrance into said contactor support body, to make electrical contact with the downstream ends of said contactor tubes.

2. An electrical connector as described in claim 1, which includes a conductor anchoring assembly within at least one of said contactor tubes, and comprising:

an internal annular shoulder in said contactor tube for location upstream from the corresponding conductor end;

a conductor tip, of electrically conductive material, with means for mechanically and electrically secure attachment to the end of said conductor, said conductor tip having an internally threaded upstream end;

a fastener mating with said upstream threaded opening of said tip, said fastener seating on the upstream side of said internal contactor shoulder, and adapted to tighten said conductor tip into mechanically and electrically secure engagement with the interior of said contactor tube; and sealing-ring means encircling the head of said fastener and seating on said interior shoulder of said contactor tube to provide pressure-resistant sealing at said shoulder.

3. An electrical connector as described in claim 2, in which at least one of said contactor tubes is fabricated of a resilient conductive material, said contactor tube has its downstream end provided with a plurality of longitudinal slits in the portion receiving said conductor tip, to separate said downstream portion of said contactor tube into separate finger means engaging said conductor tip; and spring means urging said finger means into engagement with said conductor tip.

4. An electrical connector as described in claim 1 for assembly to the end of an armored cable having a plurality of insulated conductors, a sheath of rubber-like insulating material surrounding said conductors, and an external jacket of armor, which connector includes an armor-fitting ring of rigid material, which ring seats on the upstream end of said armor, at the upstream end of said armor-gripping shoulder, and closely receives said sheath, to provide a rigid enclosure for the downstream end of said resilient, rubber-like armor-seal body.

5. An electrical connector as described in claim 1, in which said housing is divided into two half-housings along upstream-downstream lines, and said housings are provided with fastener means for tightening said half-housings to provide a rigid walled enclosure for said resilient bodies within said connector.

6. An electrical connector as described in claim 1 in which said housing has an upstream coupler-receiving opening internally threaded, and the external surfaces of said coupling sleeve are provided with said means mating with said receiver opening threads.

7. An electrical connector as described in claim 1 in which the upstream end of said contactor support body is provided with an external annular shoulder for making sealing engagement against the downstream end of said feed-through socket when said coupling is attached to said feed-through socket.

8. An electrical connector as described in claim 1 in which said conductor alignment body is closely received in the upstream portion of said downstream opening; said cable-seal body has at least a portion of its upstream end received into said downstream opening and seating against the downstream end of said cable alignment body; and said cable-seal body is provided with an external annular shoulder at its downstream end for making sealing contact with the downstream end of said contactor support body.

9. An electrical connector as described in claim 1 for coupling to a feed-through socket of the type which includes a male probe corresponding to each cable conductor and projecting downstream, but having greater radial spacing than the conductors of said cable, which connector is characterized by:

a conductor alignment body which increases the radial spacing of the conductors from the spacing within the cable to the spacing within the feed-through socket;

an upstream end portion of said contactor support body for filling said feed-through socket, said upstream end being provided with upstream end openings, one corresponding to each of said probes; and each of said contactor tubes is provided with an upstream tubular opening for closely receiving one of said probes, and also with resilient spring means for urging said upstream tube into secure mechanical and electrical engagement with said probe.

10. A fluid-proof electrical connector for field assembly to the end of an armored cable, said cable including a plurality of conductors, insulation on each of said conductors, a rubber-like sheath enclosing said conductors, and an outer protective armor, whereby an upstream end of said armored cable can be releasably connected to a feed-through socket, said feed-through socket including a feed-through housing opening downstream, threaded coupling means on said feed-through housing, an insulating body filling the interior of said feed-through housing at a point spaced upstream from said downstream opening, and a plurality of electrical socket-contact means supported within said insulating body and communicating with said downstream opening of said feed-through socket, said socket-contact means corresponding to the conductors of said cable, but having greater radial spacing than the spacing of the conductors of said cable; which electrical connector includes:

an elongated, substantially cylindrical connector housing, disposed longitudinally in an upstream-downstream direction, said housing including a downstream cavity closely fitting the armor of said cable, and an upstream cavity having a substantially greater diameter than said armored cable;

an armor-fitting ring closely received on the upstream end of said cable sheath and seating on the upstream termination of the armor of said cable, and also on said internal annular shoulder between said downstream and upstream cavities;

a tubular cable seal body having its downstream end seated on said armor-fitting ring, and filling the downstream end of said upstream cavity, said tubular cable-seal body having an upper portion of reduced external diameter, said tubular cable-seal body being fabricated of a resilient, rubber-like insultating material, said cable-seal body being closely received on a sheathed portion of said cable upstream from the termination of its armor;

bonding material for hermetically bonding the exterior surfaces of said cable sheath to the interior surfaces of said cable-seal body;

an alignment body made of a resilient, rubber-like insulating material seated on the upstream end of said cable-seal body, and having upstream diverging passages to accommodate the insulated conductors of said cable, and to increase their radial spacing from that of the cable to that of said feed-through socket;

a contactor assembly including:

a contactor support body fabricated of a relient rubber-like, insulating material, said contactor support body being closely received in said upstream cavity, said contactor support body having a downstream recess closely receiving the upstream part of said cable-seal body and said alignment body, said contactor support body having a plurality of passages between its downstream end and upstream end, one corresponding to each of the conductors of said cable, the radial spacing of said passages corresponding to the radial spacing of said feed-through socket, said body having an upstream projection mating with the interior of said feed-through housing, and having an external annular shoulder adapted to seat on the downstream end of said feed-through socket housing;

a rigid metal coupling sleeve encircling said contactor support body intermediate its upstream and downstream ends, said coupling sleeve having an exterior surface adapted to make sealing engagement with said upstream opening of said housing;

a coupling ring threaded to make coupling connection to said threaded feed-through socket housing, said coupling ring being rotatably mounted on the upstream end of said coupling sleeve;

a plurality of contactor assemblies, one corresponding to each of said cable conductors, each said assembly being supported in said upstream-downstream passages through said contactor support body, said contactor assemblies having substantially cylindrical sidewalls continuously bonded to the interior walls of said passages to make hermetic sealing with said contactor support body, each of said contactor assemblies including a contactor tube having an intermediate bonding section of maximum diameter which exterior surface is directly bonded to said contactor support body, said contactor tube including a downstream section of reduced cross-section for making electrical contact with one of said cable conductors, and an upstream section of reduced diameter for making electrical contact with one of said feed-through socket-contact means, said contactor assembly including a dowstream tubular housing enclosing said downstream contactor end and externally bonded to said contactor support body, and an upstream housing enclosing said upstream contactor, and externally bonded to said contactor support body.

11. An electrical connector as described in Claim 10, in which, for at least for some of said cable conductors, the cable conductor is electrically and mechanically secured within its corresponding connector tube by means of a conductor tip securely attached to the upstream end of said conductor, said tip being provided with an internally threaded bore opening upstream; an internal annular shoulder is provided within said conductor tube upstream from said intermediate portion of maximum diameter; and a headed fastener means having a threaded downstream end adapted to be received into said threaded bore of said tip, and a wrenching head at its upstream end adapted to seat on said internal annular shoulder; and sealing-ring means adapted to make sealing engagement between the upstream surfaces of said shoulder and the downstream surfaces of said fastener head.

12. An electrical connector for connecting an upstream cable-end of an armored cable to a feed-through socket located within a conduit containing fluid under high pressure;

said cable-end including a succession approaching said socket;

an armored section, a sheath section with armor removed;

an insulated conductor section with armor and sheath removed to expose a plurality of separate insulated conductors, and a conductor contact section with insulation removed from the upstream end of each conductor for electrical contact;

said socket including:

a socket housing defining a downstream opening receptacle, a set of feed-through conductors corresponding to the conductors of said cable, but disposed at greater radial spacing to maintain dielectric security at a connector within said high-pressure fluid;

a feed-through insulating supporting said feed-through conductors within said feed-through;

an annular sealing shoulder at the opening of said receptacle;

and threaded coupling means in the walls of said socket housing; which connector comprises:

an elongated housing enclosing an armor-gripping downstream cavity, for closely receiving said armored section of said cable end, and a body-containing upstream cavity for providing a rigid walled enclosure for deformable insulating bodies within said connector, said housing including a ring-seating shoulder at the upstream end of said downstream cavity, and an annular coupling-sleeve shoulder encircling an upstream opening at the upstream end of said housing;

an armor-fitting ring seated on said armor-seating shoulder, and closely fitting said sheath section at its downstream end, for providing rigid-walled confinement to deformable bodies within said connector housing;

a tubular seal body fabricated of resilient, rubber-like, insulating material deformable under the pressure of said fluid, said body seating on said armor-fitting ring, the interior surface of said body making hermetic sealing contact with said sheath section of said cable end, the exterior surface of said body being divided into an enlarged downstream shoulder closely fitting the adjacent interior sidewalls of said upstream cavity, and an upstream section of reduced diameter spaced away from the sidewalls of said upstream cavity;

an alignment body fabricated of a resilient, rubber-like, insulating material deformable under the pressure of said fluid, said alignment body being seated on the upper end of said seal body, said alignment body having upwardly diverging passages to accommodate the insulated conductors from said cable end, and to increase their radial spacing to that of said feed-through conductors, said alignment body having exterior sidewalls spaced inwardly from the interior sidewalls of said upstream cavity;

a contactor support body fabricated resilient, rubber-like, dielectric material deformable under the pressure of said fluid, said support body substantially filling said upstream cavity, said support body having its downstream end seating on said annular shoulder of said seal body, said support body having a downstream recess for closely receiving said seal body and said alignment body, said support body having a coupling-seal section at its upstream end, spaced upstream from said housing, and said section comprising an external annular shoulder for sealing against said annular sealing shoulder of said receptacle, and an upstream projection for at least partially filling said socket receptacle, and said support body being provided with a plurality of contactor passages between its downstream and upstream ends, one of said passages corresponding to each of said cable conductors;

a plurality of contactor means, one supported in each of said contactor passages for providing electrical communication between the conductors of said cable and said feed-through conductors, said contactor means having their external surfaces hermetically sealed to the adjacent walls of said contactor passages in said contactor support body; and a coupling assembly comprising:

a coupling sleeve mating with said coupling-sleeve shoulder at the upstream end of said housing, said coupling sleeve being hermetically sealed to said contactor support body, said coupling sleeve having an upstream end projecting above said housing; and a threaded coupling ring mating with said threaded coupling means in the walls of said socket housing, said coupling ring being rotatably mounted on said coupling sleeve, whereby said connector may be threadably coupled to said feed-through socket with sealing against said annular sealing shoulder on said contactor support body.

13. An electrical connector as described in claim 12 in which those of said contactor means which are provided for the transmission of power are contactor assemblies comprising:

a contactor tube of resilient conducting metal, said tube having its upstream and downstream ends of reduced cross-section diameter, and an intermediate section of enlarged diameter having external sidewalls hermetically sealed to said contactor support body;

upstream and downstream tubular housings for said upstream and downstream finger sections of said contactor tube, said housings having their exterior walls hermetically sealed to said contactor support body;

upstream and downstream spring means on said upstream and downstream finger sections for urging them into secure electrical contact with the socket contactors and the conductor ends, respectively; and a conductor anchoring assembly for each cable conductor comprising:

an internally threaded conductor tip adapted to be firmly attached to one of said cable conductor ends;

a threaded fastener means for close reception to the interior of said contactor tube at the intermediate section thereof, said threaded fastener means having a downstream threaded end mating with said internally threaded tip, and an unstream head end provided with torqueing surfaces, and adapted to make sealing engagement with the interior walls of said contactor tube; and sealing-ring means for making sealing contact between said upstream fastener head and the interior sidewals of said contactor tube.

14. An electrical connector for connecting an armored cable, with multiple conductors, to a feedthrough socket;

a substantially cylindrical housing made of rigid material and axially aligned with said armored cable, said housing having an upstream end adjacent said socket and a downstream end adjacent said cable;

an armor-gripping shoulder at the downstream end of said housing, said shoulder providing an internal surface, substantially cylindrical, closely fitting the exterior surface of the armor of said armored cable;

a coupling-receiving opening at the upstream end of said housing;

a contactor assembly comprising:

a contactor support body made of a resilient, rubber-like, dielectric material, said body substantially filling the upstream portion of said housing, said body having an upstream end projecting above said housing to meet with said feedthrough socket, said body having an axial opening in the downstream end to provide a depending skirt of tubular configuration;

a socket-coupling means encircling said contactor support body, said coupling means comprising a coupling sleeve of rigid material mating with said upstream coupling-receiver opening of said housing, and a coupling for secure coupling to said feed-through socket;

a plurality of contactor tubes, supported within said contactor support body, said tubes corresponding to each of the conductors of said cable, said tubes being made of conductive material, said tubes being aligned in an upstream-downstream direction, each of said tubes having a downstream opening for reception of one of the conductors of said cable, each of said tubes having an upstream electrical contactor portion mating with a corresponding contactor in said feedthrough socket;

a cable seal body within the downstream end of said housing, upstream from said armor-gripping shoulder, and including bonding means to a cable-end of said armored cable from which the armor has been removed; and an alignment body made of a reslient, rubber-like, dielectric material, said alignment body being disposed within said axial opening at the downstream end of said contactor support body and said alignment body having passages diverging in an upstream direction to accommodate the conductors from said cable end, and to place them in disposition for entrance into said contactor support body, to make electrical contact with the downstream ends of said contactor tubes.

15. An electrical connector for field installation to connect an end of a multi-conductor armored cable to a feedthrough socket having a contact for each of said conductors comprising:

a generally cylindrical housing of rigid material having one open end for tightly enclosing said end of said armored cable, a generally cylindrical contactor support body of resilient insulating material having a relatively long, substantially solid major portion and a relatively short minor portion having an axial opening formed therein to provide a depending skirt of tubular configuration, the outer wall of said contactor support body being sealed along a major portion of its length to the interior wall of said housing, said axial opening being larger in diameter than the outside diameter of said armored cable, a plurality of contactors sealed in said contactor support body each of said contactors being disposed for connection to one of said contacts of said feedthrough socket, means in each of said contactors for connecting each said contactor to a conductor of said armored cable, an internal annular shoulder formed at said one open end of said housing, means supported by said shoulder providing a seat for an end of said armor on said armored cable and having an opening formed centrally thereof permitting passage of the unarmored remainder of said armored cable into the volume defined by said skirt depending from said contactor support body, auxiliary support bodies of resilient insulating material disposed in and substantially filling said volume about said unarmored remainder of said cable, said auxiliary bodies having openings formed therein for the passage of said conductors of said armored cable to said contactors, and means at the other end of said housing for securely fastening said electrical connector to said feedthrough socket.

16. An electrical connector as claimed in claim 15, in which at least some of said contactors sealed in said contactor support body make connection with corresponding conductors of said armored cable by means of a construction in which:

said contactor is a tubular body with an open passage from a feedthrough socket connecting end to a conductor receiving opening at the opposite end, said tubular passage having a reduced internal diameter at an intermediate portion to provide an internal annular seating shoulder facing toward said feedthrough socket opening;

a pin-type fastener is disposed coaxially within said tubular contactor, said fastener having at its feedthrough socket end an enlarged head seating on said seating shoulder, and said fastener having a fastening end projecting toward said conductor receiving opening;

a fastener tip for attachment to the end of the conductor corresponding to said contactor, said tip having a cooperating fastening part adapted to be received into said tubular body through its said conductor receiving opening, and to make fastening engagement with said pin-tupe fastener; and sealing ring means between the head of said fastener and said seating shoulder to insure hermetic sealing within said contactor tubular body.

17. An electrical connector as claimed in claim 15 in which said means for fastening said electrical connector to said feedthrough socket includes:

a tubular sleeve of rigid material encircling said contactor support body, said body being molded to partially enclose said sleeve and make secure hermetic sealing with it; and a mating ring rotatably mounted on said tubular sleeve, said mating ring being threaded to make secure fastening with said feedthrough socket.

* * * * *